US007714245B2

(12) United States Patent
Chi

(10) Patent No.: US 7,714,245 B2
(45) **Date of Patent: *May 11, 2010**

(54) KEYSWITCH WITH BALANCE MEMBER

(75) Inventor: Chih-Yao Chi, Taipei County (TW)

(73) Assignee: Darfon Electronics Corp., Taoyuan (TW)

( * ) Notice: Subject to any disclaimer, the term of this patent is extended or adjusted under 35 U.S.C. 154(b) by 84 days.

This patent is subject to a terminal disclaimer.

(21) Appl. No.: 12/117,293

(22) Filed: May 8, 2008

(65) Prior Publication Data

US 2008/0277255 A1 Nov. 13, 2008

(30) Foreign Application Priority Data

May 11, 2007 (TW) ..... 96207614 U

(51) Int. Cl.
*H01H 13/70* (2006.01)

(52) U.S. Cl. ..... 200/344; 200/345; 200/5 A; 400/295; 400/472

(58) Field of Classification Search ..... 200/344, 200/345, 340, 512, 517, 5 A; 400/295, 296, 400/472, 290, 491

See application file for complete search history.

(56) References Cited

U.S. PATENT DOCUMENTS 6,096,989 A * 8/2000 Kinoshita ..... 200/345
6,495,782 B1 * 12/2002 Huang ..... 200/341
6,632,039 B2 * 10/2003 Lin ..... 400/490

FOREIGN PATENT DOCUMENTS

TW 319438 11/1997
TW 346213 11/1998
TW 411004 11/2000

* cited by examiner

*Primary Examiner*—Kyung Lee
(74) *Attorney, Agent, or Firm*—Morris, Manning & Martin LLP; Tim Tingkang Xia

(57) ABSTRACT

The invention discloses a keyswitch, which includes a keycap and a balance member. The keycap thereof defines a lower surface, which has at least one mounting portion. The balance member has an axle thereof defines a first end and a second end opposite to the first end. Additionally, the axle is folded with a first angle and elongated from the first end to form a first side, and folded with a second angle and elongated from the second end to form a second side. The axle is mounted in the at least one mounting portion. Particularly, the second angle is between 30° and 60°.

10 Claims, 6 Drawing Sheets

KEYSWITCH WITH BALANCE MEMBER

BACKGROUND OF THE INVENTION

1. Field of the invention

The present invention relates generally to a keyswitch, and more particularly, to a keyswitch with a balance member.

2. Description of the prior art

Generally, the keyswitch used in computer keyboard is constructed of a keycap, a substrate, and a scissors-like support disposed therebetween to support the keycap moving vertically opposite to the substrate. Moreover, when the keycap is moved downward to the substrate, it can trigger a switch disposed on the substrate. Said support has been fully disclosed in certain patent applications, as discussed in Taiwan Patent Number 319,438, entitled "Keyswitch with scissors-like support". The above-mentioned structure is mainly suitable for square keyswitch. However, a balance member is needed for a longer keyswitch or a keyswitch with special shape (such as multiple key or functional keyswitch "space", "shift", or "enter") to prevent said keyswitch tilt when a user presses on the edge of said keyswitch.

In the prior art, such as Taiwan Patent Number 346,213, entitled "Improved structure of multiple key", and Taiwan Patent Number 411,004, entitled "Improved structure of balance member of multiple key", the above-mentioned balance member is designed as U shape to perform said functionality. Please refer to FIG. 1A, which illustrates the keycap and the balance member of the prior art. As shown in FIG. 1A, the balance member 52 is engaged with the fixing portion 504 of the bottom surface 502 of the keycap 50.

However, in practice, the keycap of the multiple key may be designed as a trapezium, a triangle or other polygon. Please refer to FIG. 1B, which shows the keycap and the balance member in the prior art. As shown in FIG. 1B, the appearance of the keycap 70 is substantially a trapezium. Accordingly, the conventional U-shaped balance member 72 can not cover the whole keycap 70. Moreover, when an user presses on the edge (e.g. the portion marked with the dotted circle may tilt as mentioned above) of said keycap 70, the keycap 70 may tilt, and the balance member 72 may even fail to drive the movement of the keycap 70 and further fail to trigger the switch disposed on the substrate.

SUMMARY OF THE INVENTION

Accordingly, a scope of the present invention is to provide a keyswitch comprising a balance member. Particularly, the balance member of the invention can be designed to fit the shape of keycap of the keyswitch to drive the movement of the keycap more completely than the conventional balance member does.

According to the first preferred embodiment, the keyswitch of the invention includes a keycap and a balance member. A bottom surface is defined on the keycap, and the bottom surface has at least a mounting portion. The balance member has an axle defining a first end and a second end opposite to the first end. The axle is folded with a first angle and elongated from the first end to form a first side, and the axle is folded with a second angle and elongated from the second end to form a second side. Additionally, the axle is mounted in the at least one mounting portion. Particularly, the second angle is between 30 degree and 60 degree.

Another scope of the present invention is to provide a keyboard comprises a plurality of keyswitches, and at least one of the keyswitches comprises a balance member.

According to the second preferred embodiment, the keyboard comprises a substrate, a plurality of switch, a plurality of support, a plurality of keycap and a balance member. The switches are disposed on the substrate, and each of the supports corresponds to one of the plurality of switches. Each of the supports has an upper engagement portion and a lower engagement portion. Each of the keycaps corresponds to one of the switches and one of the supports, and a bottom surface is defined on each of the keycaps. Moreover, at least one of the bottom surfaces has at least a mounting portion. The balance member has an axle defining a first end and a second end opposite to the first end. The axle is folded with a first angle and elongated from the first end to form a first side, and the axle is folded with a second angle and elongated from the second end to form a second side. Furthermore, the axle is mounted in the at least one mounting portion. Particularly, the second angle is between 30 degree and 60 degree.

Additionally, each of the supports is mounted to the bottom surface by the upper engagement portion and is mounted to the substrate by the lower engagement portion, so as to support the corresponded keycap moving vertically opposite to the substrate. Moreover, each of the switches is selectively turned on in response to the movement of the keycap.

The objective of the present invention will no doubt become obvious to those of ordinary skill in the art after reading the following detailed description of the preferred embodiment, which is illustrated in the various figures and drawings.

BRIEF DESCRIPTION OF THE APPENDED DRAWINGS

DETAILED DESCRIPTION OF THE INVENTION

Figure 1A:
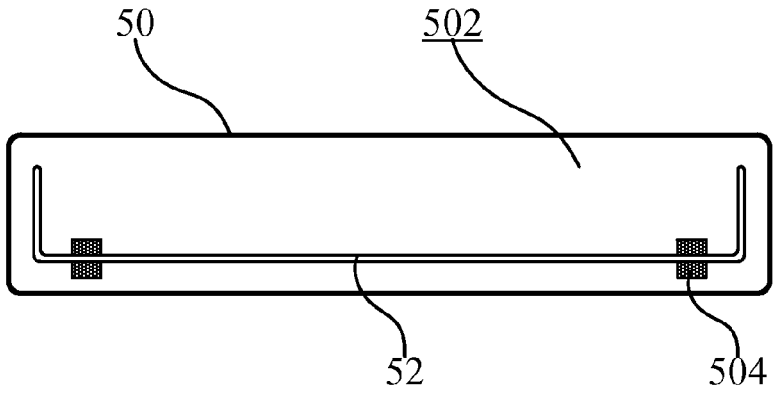
FIG. 1A (prior art)
FIG. 1A illustrates the keycap and the balance member in the prior art.
Figure 1B:
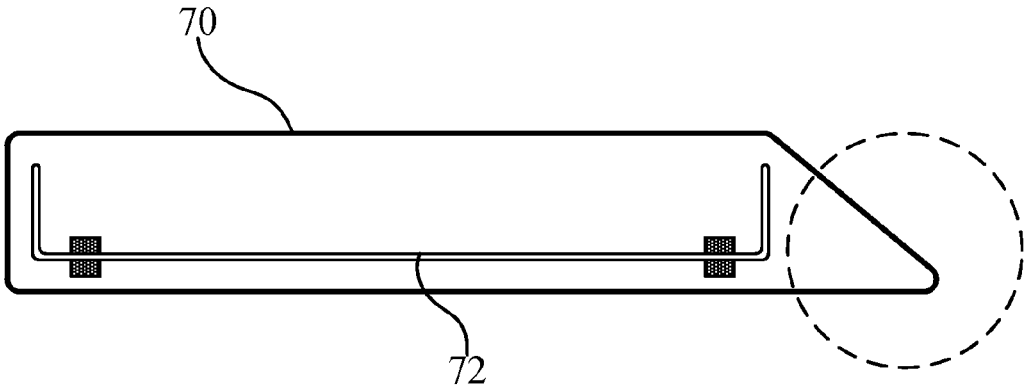
FIG. 1B (prior art)
FIG. 1B illustrates the keycap and the balance member in the prior art.
Figure 2:
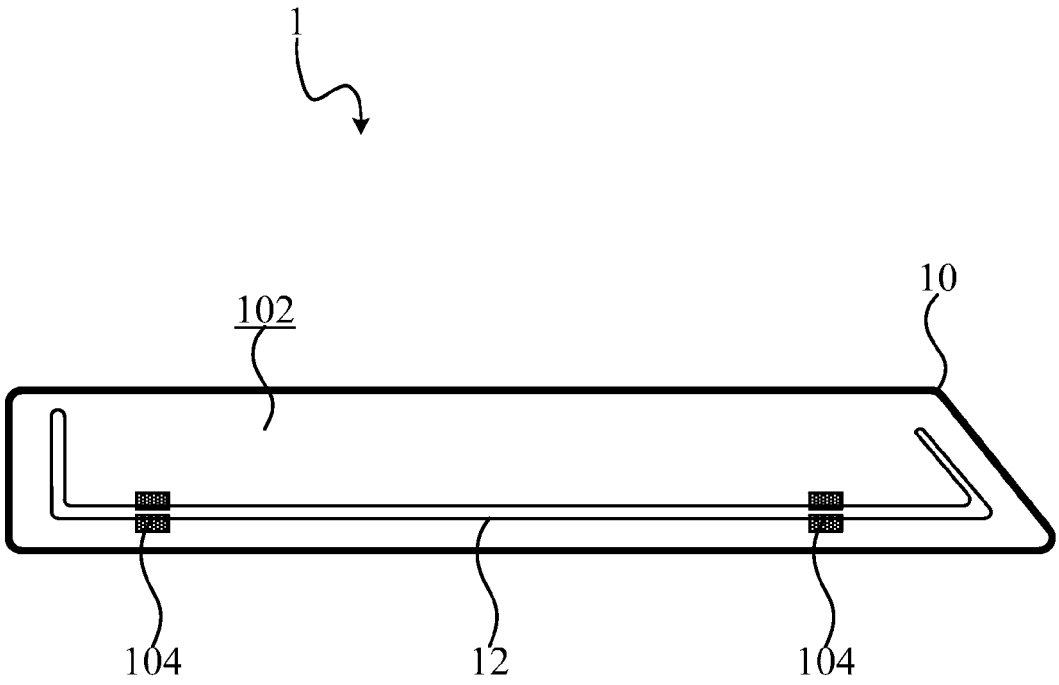
FIG. 2 illustrates the keycap and the balance member of the keyswitch of an embodiment of the invention.
Figure 3:
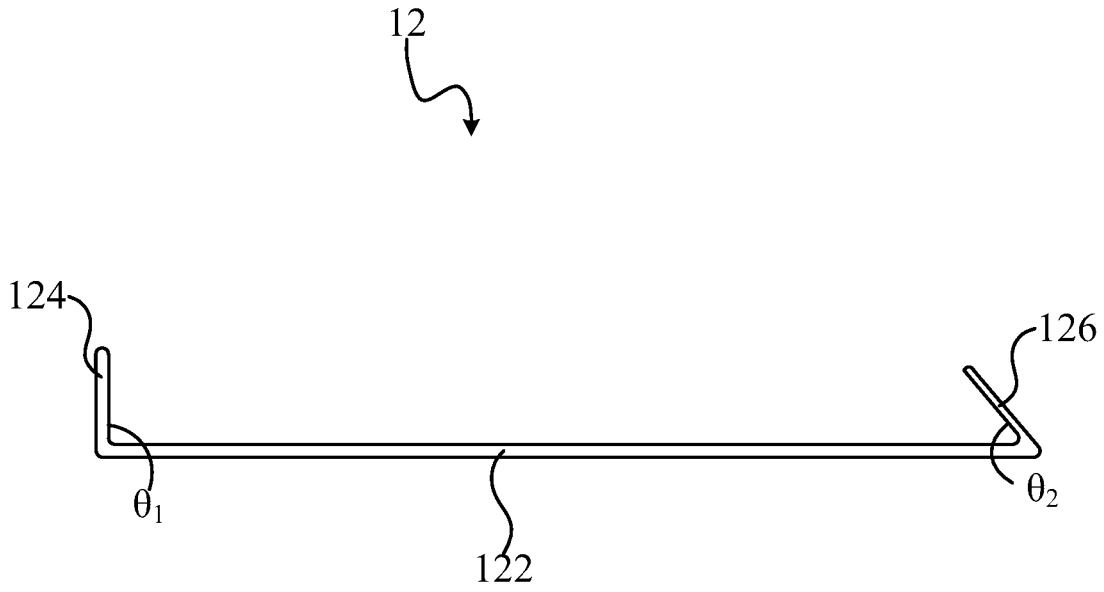
FIG. 3 illustrates the balance member of the invention.

Please refer to FIG. 2 and FIG. 3. FIG. 2 illustrates the keycap and the balance member of the keyswitch of an embodiment of the invention; and FIG. 3 further illustrates the balance member. In the embodiment, the keyswitch 1 includes a keycap 10 and a balance member 12. A bottom surface 102 is defined on the keycap 10, and the bottom surface 102 has two mounting portions 104.

The balance member 12 has an axle 122 defining a first end and a second end opposite to the first end. The axle 122 is folded with a first angle $\theta_1$ and elongated from the first end to form a first side 124, and the axle 122 is folded with a second angle $\theta_2$ and elongated from the second end to form a second side 126. As shown in FIG. 2, the axle 122 is mounted in these mounting portions 104, so that the axle 122 can rotate relatively to the keycap 10. Particularly, the second angle $\theta_2$ is between 30 degree and 60 degree, such as 45 degree.

In an embodiment, the keyswitch of the invention further includes a substrate, a switch and a support. The substrate has a first connecting member and a second connecting member. The switch is disposed on the substrate. The support can be used to support the keycap moving vertically opposite to the substrate. The support has an upper engagement portion coupled to the bottom surface, and a lower engagement portion coupled to the substrate.

Furthermore, the first side and the second side of the balance member are connected to the first connecting member and the second connecting member respectively. The switch is selectively turned on in response to the movement of the keycap. For example, when the keycap is pressed downward to the substrate, the switch will be turned on; and when the keycap is released from the pressed position, the switch will be turned off.

Figure 5A:
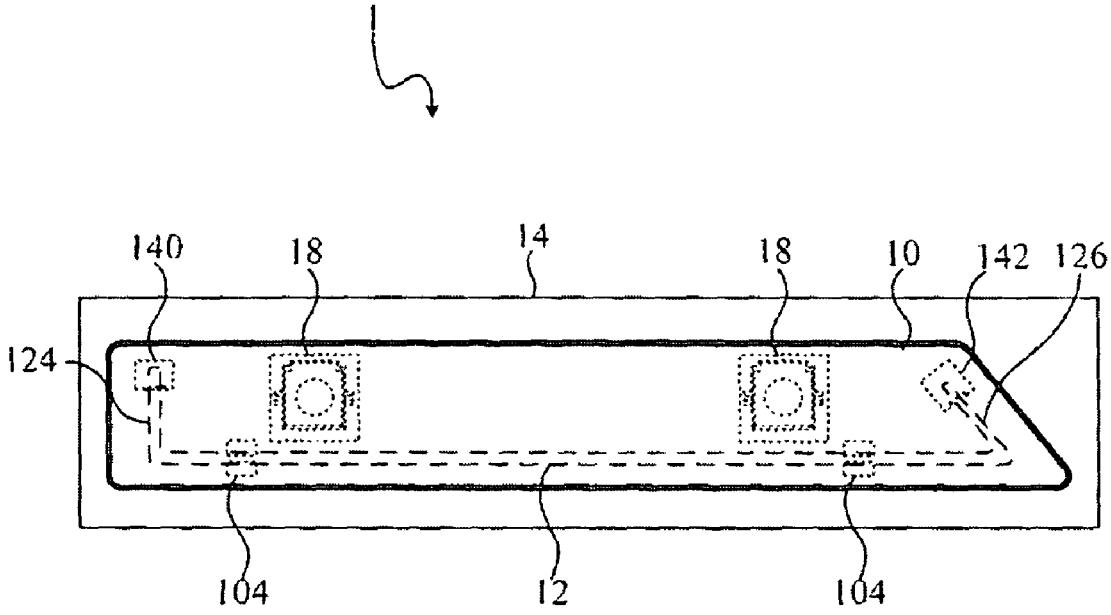
FIG. 5A illustrates that the keycap and the balance member in FIG. 2 are configured on a substrate.
Figure 5B:
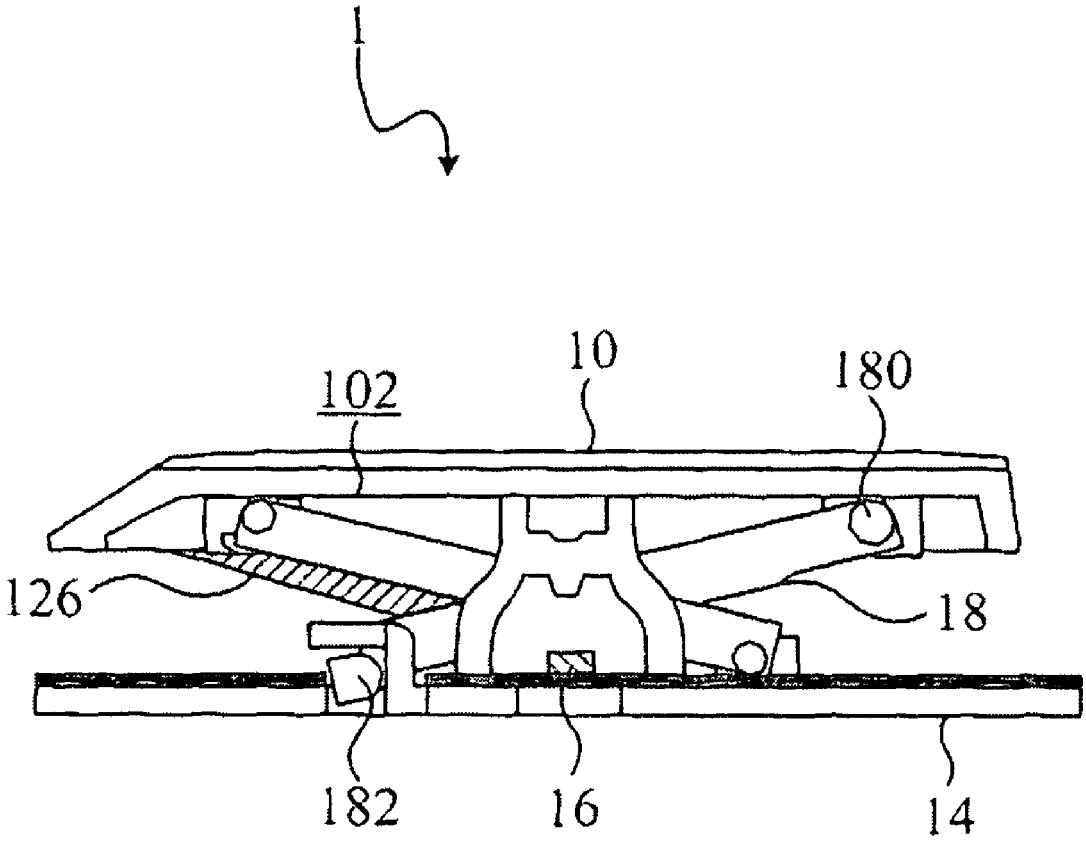
FIG. 5B is a cross-section diagram illustrating the keyswitch in FIG. 5A.

Please refer to FIGS. 5A and 5B, FIG. 5A illustrates that the keycap and the balance member in FIG. 2 are configured on a substrate, and FIG. 5B is a cross-section diagram illustrating the keyswitch in FIG. 5A. As shown in FIG. 5A and FIG. 5B, in addition to the keycap 10 and the balance member 12, the keyswitch 1 further comprises a substrate 14, a switch 16, and a support 18. A first connecting member 140 and a second connecting member 142 are configured on the substrate 14, and the first side 124 and the second side 126 of the balance member 12 are connected to the first connecting member 140 and the second connecting member 142 respectively. The support 18 is coupled to the bottom surface 102 of the keycap 10 by an upper engagement portion 180 and coupled to the substrate 14 by a lower engagement portion 182 for supporting the keycap 10 moving vertically opposite to the substrate 14. When the keycap 10 moves, the switch 16 could be triggered to make the switch 16 to be turned on.

Figure 4:
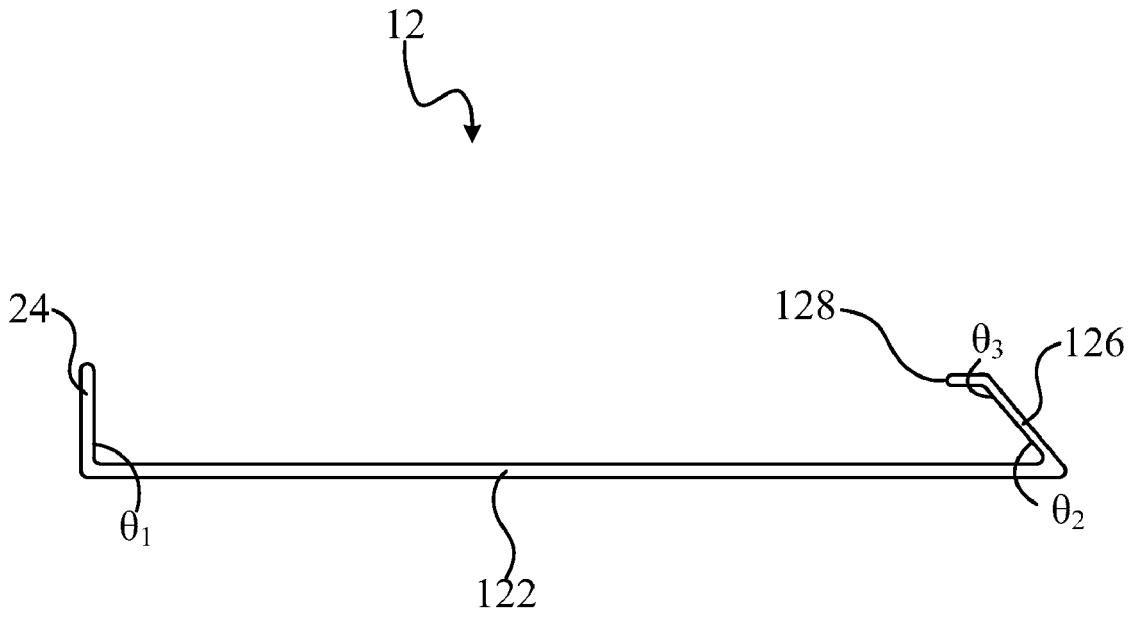
FIG. 4 illustrates the balance member of the invention.

Please refer to FIG. 4, which shows the balance member of an embodiment of the invention. In the embodiment, a third end is defined on the second side 126 of the balance member 12, and the second side 126 is folded with a third angle $\theta_3$ and elongated from the third end to form a third side 128.

Furthermore, in the embodiment, the balance member 12 is connected to the above-mentioned first connecting member and second connecting member by the first side 124 and the third side 128, so as to cooperate with the support to support the movement of the keycap.

Practically, the above-mentioned first angle $\theta_1$ is substantially equal to 90 degree, and the second angle $\theta_2$ is substantially equal to 45 degree. However, in practice, the first angle, the second angle and the third angle can optionally be adjusted to any other suitable degree.

In a preferred embodiment, the invention further provides a keyboard with the above-mentioned keyswitches. The keyboard includes a substrate, a plurality of switches, a plurality of supports, a plurality of keycaps and at least a balance member.

The switches are disposed on the substrate, and each of the supports corresponds to one of the switches. Each support has an upper engagement portion and a lower engagement portion. Each of the keycaps corresponds to one of the switches and one of the supports, and a bottom surface is defined on the keycap. Particularly, at least one of the bottom surfaces has at least a mounting portion.

The balance member has an axle defining a first end and a second end opposite to the first end. The axle is folded with a first angle and elongated from the first end to form a first side, and the axle is folded with a second angle and elongated from the second end to form a second side. Moreover, the axle is mounted in the at least one mounting portion. Additionally, as mentioned above, the second angle is between 30 degree and 60 degree.

Furthermore, each of the supports is mounted to the bottom surface by the upper engagement portion and is mounted to the substrate by the lower engagement portion, so as to support the corresponded keycap moving vertically opposite to the substrate. Moreover, each of the switches is selectively turned on in response to the movement of the corresponded keycap.

In an embodiment, the substrate of the keyboard further has a first connecting member and a second connecting member opposite to the first connecting member. The first side and the second side of the balance member are connected to the first connecting member and the second connecting member respectively. Accordingly, the balance member can cooperate with the support to support the movement of the keycap.

In another embodiment, the substrate of the keyboard further has a first connecting member and a second connecting member opposite to the first connecting member. Furthermore, as shown in FIG. 4, a third end is defined on the second side of the balance member, and the second side is folded with a third angle and elongated from the third end to form a third side. The first side and the third side of the balance member are connected to the first connecting member and the second connecting member respectively. Accordingly, the balance member can cooperate with the support to support the movement of the keycap.

Practically, the above-mentioned first angle $\theta_1$ is substantially equal to 90 degree, and the second angle $\theta_2$ is substantially equal to 45 degree. However, in practice, the first angle, the second angle and the third angle can optionally be adjusted to any other suitable degree.

Practically, the keyswitch with the balance member of the invention can be, but not limited to multiple key, such as "space", "shift", "enter", or "backspace"; or keys with irregular shape, such as "enter".

To sum up, the balance member of the invention can fit keyswitches with different shape, so as to drive the movement of the keycap more completely than the conventional balance member does.

Although the present invention has been illustrated and described with reference to the preferred embodiment thereof, it should be understood that it is in no way limited to the details of such embodiment but is capable of numerous modifications within the scope of the appended claims.

What is claimed is:

1. An electrical connector, comprising:

a keycap defining a bottom surface, and the bottom surface having at least a mounting portion;

a balance member having an axle defining a first end and a second end opposite to the first end, the axle being folded with a first angle and elongated from the first end to form a first side, and the axle being folded with a second angle and elongated from the second end to form a second side, and the axle is mounted in the at least one mounting portion, wherein the second angle is between 30 degree and 60 degree;

a substrate having a first connecting member and a second connecting member opposite to the first connecting member;

a switch disposed on the substrate; and a support for supporting the keycap moving vertically opposite to the substrate, the support having an upper engagement portion coupling to the bottom surface, and a lower engagement portion coupling to the substrate, wherein the first side and the second side of the balance member are connected to the first connecting member and the second connecting member respectively;

wherein the switch is selectively turned on in response to the movement of the keycap;

wherein the axle is folded with a first angle and elongated from the first end to form a first side, and the axle is folded with a second angle and elongated from the second end to form a second side, and the axle is mounted in the at least one mounting portion; and wherein the second angle is between 30 degree and 60 degree.

2. The keyswitch of claim 1, wherein the first angle is substantially equal to 90 degree.

3. The keyswitch of claim 1, wherein the second angle is substantially equal to 45 degree.

4. A keyboard comprising:

a substrate having a first connecting member and a second connecting member opposite to the first connecting member;

a plurality of switches disposed on the substrate;

a plurality of supports which each corresponds to one of the switches, and each of the supports having an upper engagement portion and a lower engagement portion;

a plurality of keycaps which each corresponds to one of the switches and the supports, and each of the key caps defining a bottom surface, and at least one of the bottom surfaces having at least a mounting portion; and a balance member having an axle defining a first end and a second end opposite to the first end;

wherein the axle is folded with a first angle and elongated from the first end to form a first side, and the axle is folded with a second angle and elongated from the second end to form a second side, and the axle is mounted in the at least one mounting portion, the first side and the second side of the balance member are connected to the first connecting member and the second connecting member respectively;

wherein the second angle is between 30 degree and 60 degree;

wherein each of the supports is mounted to the bottom surface by the upper engagement portion and is mounted to the substrate by the lower engagement portion, so as to support the corresponded keycap moving vertically opposite to the substrate, and each of the switches selectively turning on in response to the movement of the corresponded keycap.

5. The keyboard of claim 4, wherein the substrate further having a first connecting member and a second connecting member opposite to the first connecting member, and the second side of the balance member defining a third end, and the second side is folded with a third angle and elongated from the third end to Form a third side, and the first side and the third side of the balance member are connected to the first connecting member and the second connecting member respectively.

6. The keyboard of claim 4, wherein the first angle is substantially equal to 90 degree.

7. The keyboard of claim 4, wherein the second angle is substantially equal to 45 degree.

8. A keyswitch comprising:

a keycap defining a bottom surface, and the bottom surface having at least a mounting portion;

a balance member having an axle defining a first end and a second end Opposite to the first end, the axle being folded with a first angle and elongated from the first end to form a first side, and the axle being folded with a second angle and elongated from the second end to form a second side, and the axle is mounted in the at least one mounting portion, the second side defining a third end and being folded with a third angle and elongated from the third end to form a third side, wherein the second angle is between 30 degree and 60 degree;

a substrate having a first connecting member and a second connecting member opposite to the first connecting member:

a switch disposed on the substrate; and a support for supporting the keycap moving vertically opposite to the substrate, the support having an upper engagement portion coupling to the bottom surface, and a lower engagement portion coupling to the substrate;

wherein the first side and the second side of the balance member are connected to the first connecting member and the second connecting member respectively;

wherein the switch is selectively turned on in response to the movement of the keycap.

9. The keyswitch of claim 8, wherein the first angle is substantially equal to 90 degree.

10. The keyswitch of claim 8, wherein the second angle is substantially equal to 45 degree.

* * * * *